US006189428B1

(12) United States Patent
Hoshino

(10) Patent No.: US 6,189,428 B1
(45) Date of Patent: Feb. 20, 2001

(54) SAFETY DEVICE FOR A POWER TAPE CUTTER

(75) Inventor: Hiroyasu Hoshino, Tokyo (JP)

(73) Assignee: Elm International Corporation, Tokyo (JP)

( * ) Notice: Under 35 U.S.C. 154(b), the term of this patent shall be extended for 0 days.

(21) Appl. No.: 09/200,889

(22) Filed: Nov. 27, 1998

(30) Foreign Application Priority Data

Nov. 28, 1997 (JP) ..... 9-344229

(51) Int. Cl.[7] ..... B26D 7/06
(52) U.S. Cl. ..... 83/147; 83/397
(58) Field of Search ..... 83/147, 358, 397, 83/398, 575, 679, 649, 149, 544, DIG. 1, 547, 546, 860, 397.1

(56) References Cited

U.S. PATENT DOCUMENTS

| | | | | |
|---|---|---|---|---|
| 495,999 | * | 4/1893 | Quigg | 83/544 |
| 2,290,223 | * | 7/1942 | Black et al. | 83/398 |
| 2,496,080 | * | 1/1950 | Wimer | 83/649 |
| 4,157,670 | * | 6/1979 | Herring | 83/165 |
| 4,488,466 | * | 12/1984 | Jones | 83/649 |
| 4,732,068 | * | 3/1988 | Yasuda et al. | 83/575 |
| 5,579,669 | * | 12/1996 | Kind et al. | 83/13 |

FOREIGN PATENT DOCUMENTS

| | | | | |
|---|---|---|---|---|
| 0216794 | * | 8/1989 | (JP) | 83/649 |

* cited by examiner

*Primary Examiner*—Rinaldi I. Rada
*Assistant Examiner*—Omar Flores-Sańchez
(74) *Attorney, Agent, or Firm*—Oblon, Spivak, McClelland, Maier & Neustadt, P.C.

(57) ABSTRACT

A safety device for a power tape cutter is provided to prevent accidents due to the power blade as far as possible. In the power tape cutter, which leads out adhesive tape through an outlet and cuts it to a required length using a power blade, a movable shutter, which inhibits a user's fingers from being inserted into the outlet, is disposed outside the power blade at the outlet. Due to the presence of a spring, the shutter naturally tends to close of its own accord. The movable shutter is provided with a retaining section which retains the movable shutter, locking it in an open position and unlocking it when a device driver responds to a signal to start cutting the adhesive tape. The movable shutter is also provided with a power blade drive switch which operates in conjunction with the movable shutter. When the shutter is substantially closed, the operation of the power blade drive switch causes the power blade to start to cut the adhesive tape. When the power blade returns to its original position after it cuts the adhesive tape, the movable shutter is opened so that it can return a state where it is locked in the open position.

12 Claims, 8 Drawing Sheets

SAFETY DEVICE FOR A POWER TAPE CUTTER

FIELD OF THE INVENTION

The present invention relates to a safety device for a power tape cutter that leads out an end of wound adhesive tape through an outlet of a casing and cuts it by driving a power blade provided at the outlet. In this way, fingers are prevented from being inserted into the outlet, thus reducing the chance of accident due to the power blade.

PRIOR ART

A power tape cutter which leads out a required length of adhesive tape through an outlet of a casing and cuts the tape by driving a power blade provided at the outlet has been known from, for example, Japanese Unexamined Patent Publication No. 6-71972. During the use of these tape cutters, fingers are often brought close to an outlet to properly lead out adhesive tape through the outlet. Thus an injury may occur despite safety precautions if a power blade is operated, with a finger mistakenly inserted into the outlet.

SUMMARY OF THE INVENTION

It is an object of the present invention to provide a safety device having a simple structure which is adapted to prevent an accident due to a power blade in the above-described power tape cutter.

It is a more specific object of the present invention to prevent a finger from being inserted into an adhesive tape outlet by using a movable shutter, and to provide a safety device arranged to discontinue a cutting operation if the movable shutter does not operate properly.

A safety device of the present invention intended to attaint the above objectives is characterized in that a power tape cutter leads out a length of wound adhesive tape through an outlet and cuts it by driving a power blade at the outlet; a movable shutter which prevents a finger from being inserted into the outlet is disposed outside the power blade at the outlet so that the shutter is pushed in a closing direction by spring and can open or close; the movable shutter is provided with (a) a means to retain the movable shutter to lock it in an open position and which unlocks the shutter when an operator operates according to a signal for starting to cut adhesive tape and (b) a power blade drive switch which operates in cooperation with the retaining means when the movable shutter is substantially closed; a power blade drive means is provided which starts to cut adhesive tape using the power blade when the power blade drive switch operates and which opens the movable shutter and then returns it to a state in which the retaining means locks the shutter in an open position when the power blade returns to its original position after cutting adhesive tape.

For the safety device, it is effective to (a) lift the power blade from below a fixed blade above the adhesive tape outlet, (b) provide a retaining plate, which ascends or descends together with the power blade, with a retaining edge that retains a claw of the movable shutter when the power blade drive means lowers the power blade and that returns the movable shutter to a position where the retaining means can keep the shutter locked in the open position, and (c) from the retaining means with a retaining piece that has a retaining hook that separates from a retaining step according to the command of the operator and a pressing part for separating the claw from the retaining edge of the retaining plate. It is desirable that the operator, which unlocks the movable shutter, which is in turn locked by the retaining means, be formed with a solenoid.

For a power tape cutter arranged as described above, a sensor senses whether a length of adhesive tape, delivered through the outlet and cut, has been removed. Alternately when an operation button is pressed to cause adhesive tape to be delivered and cut, a signal for starting tape cutting is output; the operator, consisting of a solenoid or the like, operates according to the signal; the retaining hook of the retaining piece separates from the retaining step in the movable shutter; and the pressing part of the retaining piece separates the claw of the movable shutter from the retaining edge of the retaining plate after a predetermined length of tape is delivered, so that the movable shutter is unlocked and closes the outlet using force from the spring, thus preventing fingers from being inserted into the outlet. The closure of the outlet by the movable shutter causes the power blade drive switch to operate, so that the power blade starts a cutting operation. However, if the movable shutter does not close the outlet properly because a finger or the like has been inserted into the outlet or because tape has been attached to the surroundings of the outlet, the power blade drive switch does not operate, which in turn means that the power blade does not cut adhesive tape.

When the power blade drive switch operates, the power blade drive means are driven, the power blade moves up to cut adhesive tape which has been led out until it projects a required length from the outlet, and then the power blade returns down to its original position. When the power blade returns to its original position, the retaining edge of the retaining plate, which ascends or descends together with the power blade, retains the claw and opens the movable shutter to return it to a state where the retaining means can keep the shutter in the open position; that is, to a position where the retaining hook of the retaining piece retains the retaining step of the movable shutter, thus keeping the shutter in the open position, and makes the movable shutter wait for a signal for starting the next cutting and delivery operation.

Thus when adhesive tape starts to be delivered and cut, the movable shutter prevents a finger from being inserted into the outlet for adhesive tape. Moreover, if the movable shutter does not operate properly, the delivery and cutting operation is discontinued, thus preventing an accident due to the power blade as much as possible.

DESCRIPTION OF THE EMBODIMENTS

Figure 1:
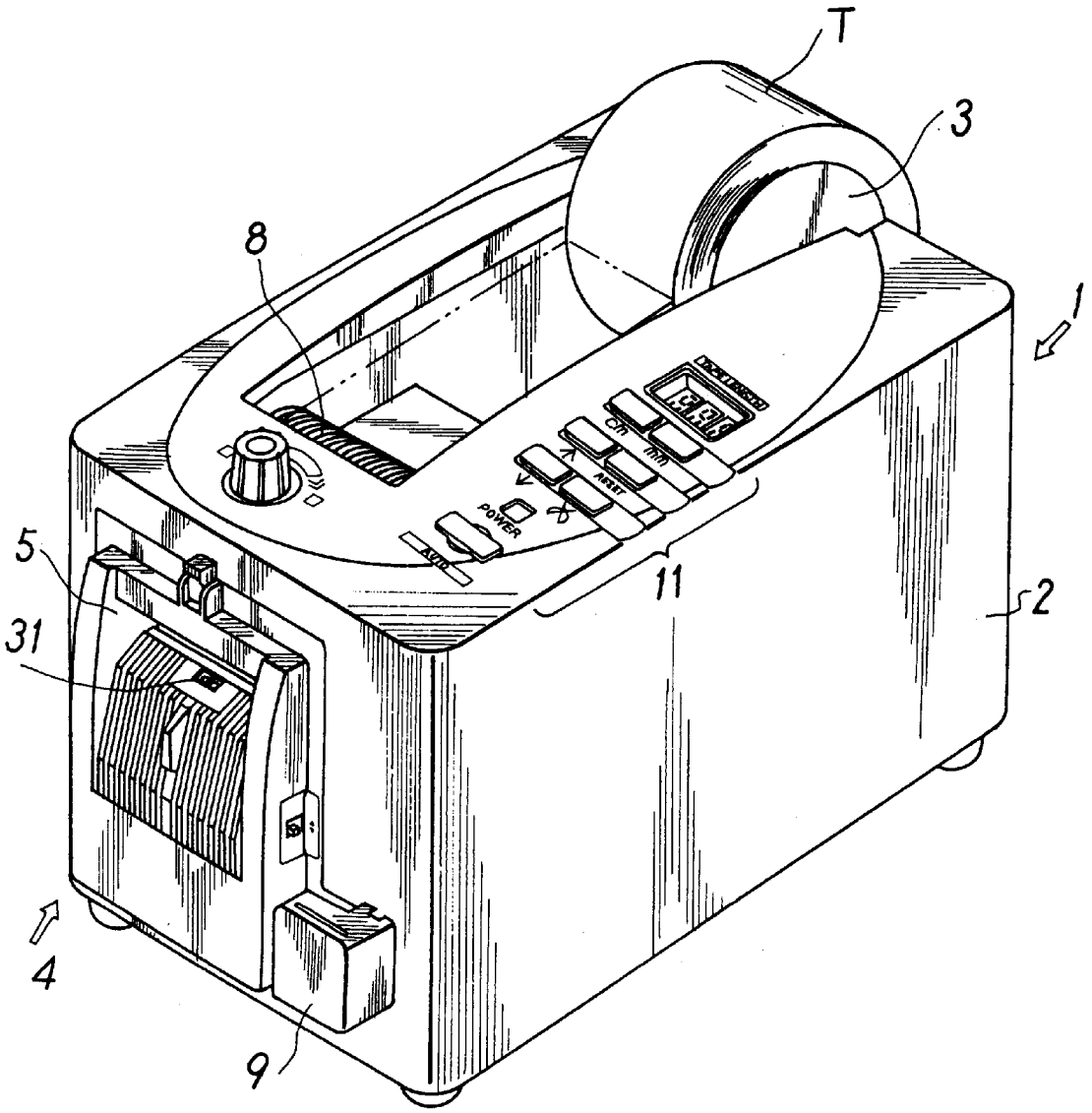
FIG. 1 is a oblique view of a power tape cutter having a safety device according to the present invention.
Figure 2:
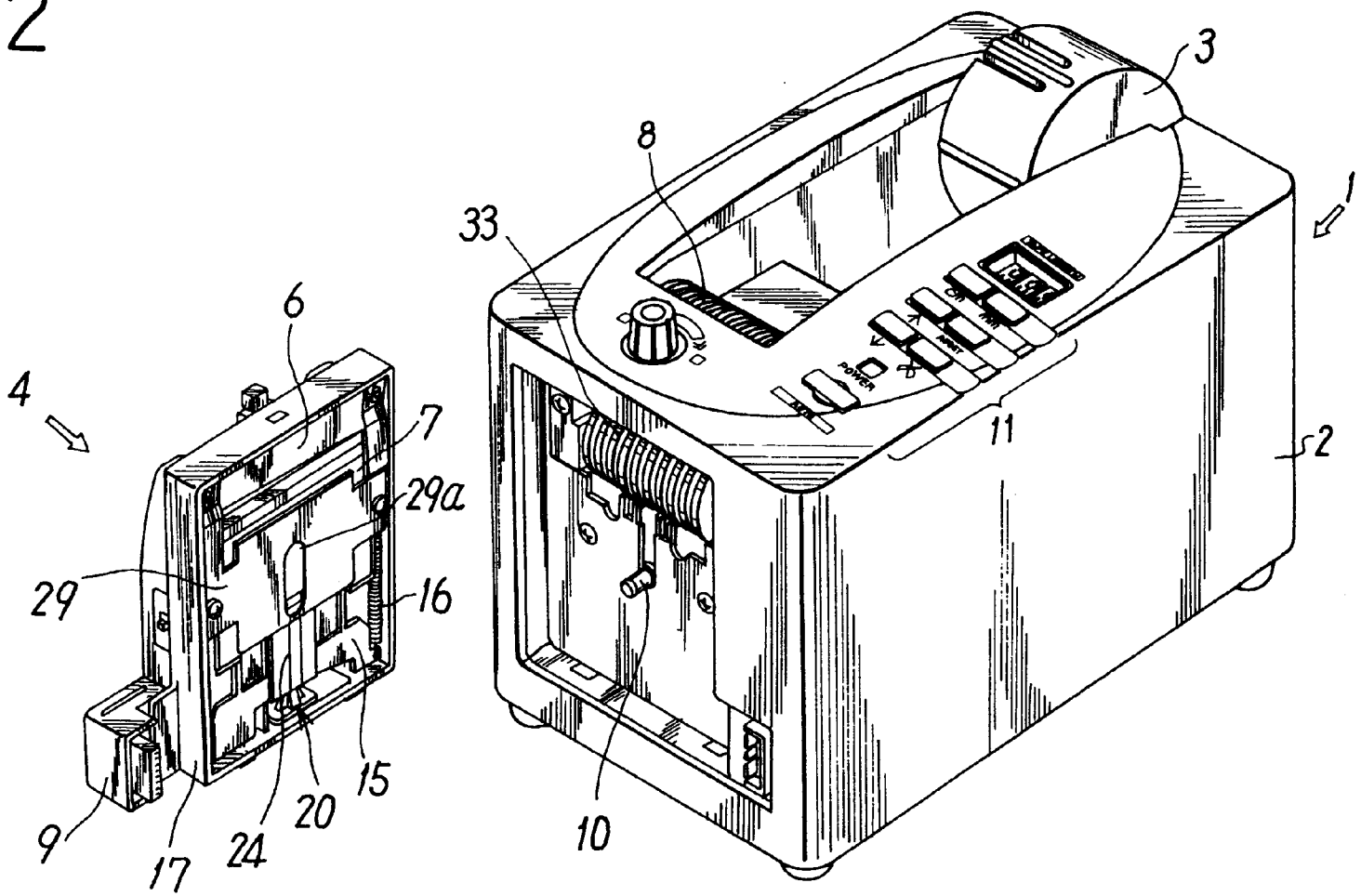
FIG. 2 is a partially enlarged oblique view of the embodiment.
Figure 9:
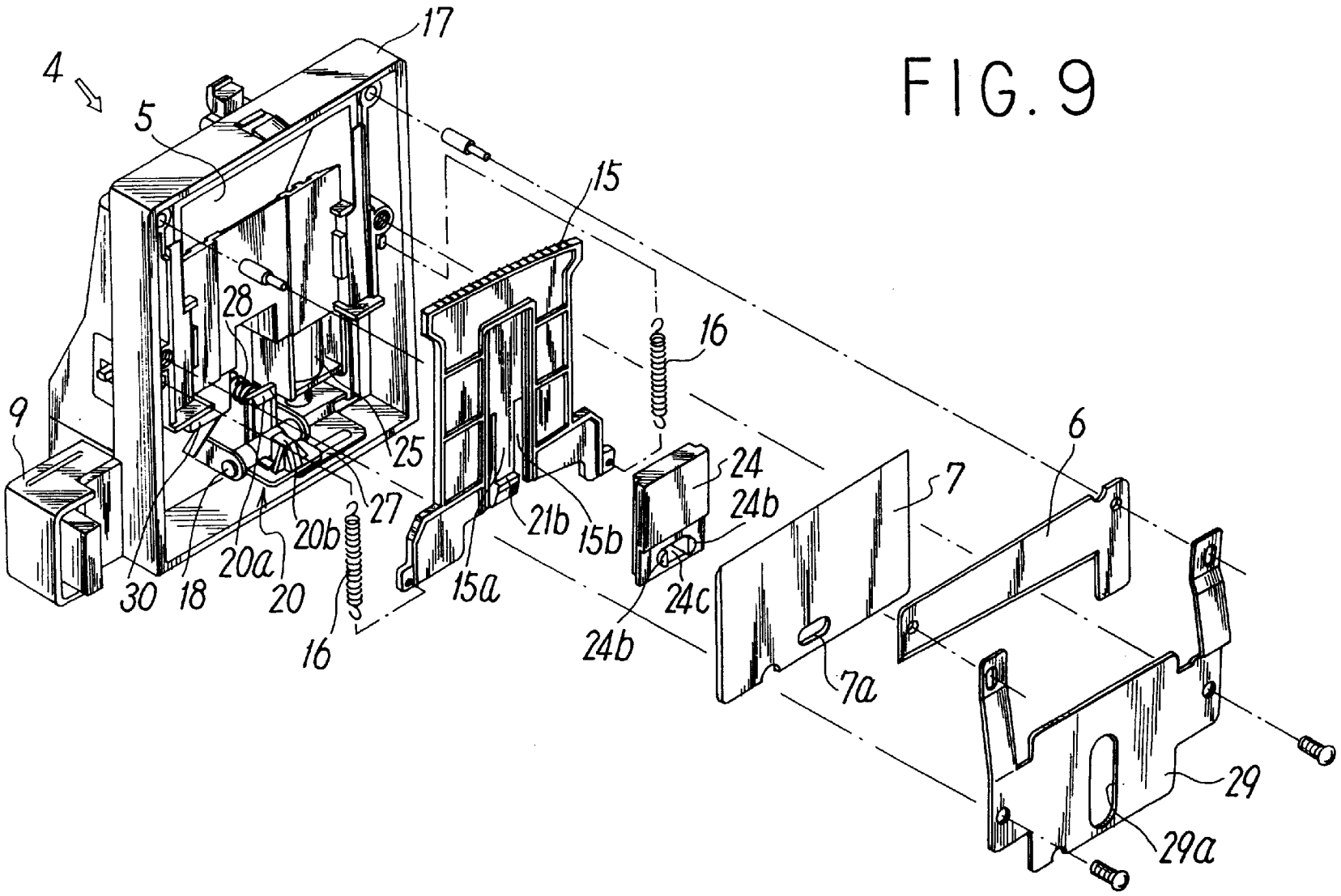
FIG. 9 is an enlarged oblique view of the cutter unit.

The drawings picture a power tape cutter equipped with a safety device constructed according to the guidelines of the present invention. To cut a required length of adhesive wound tape T around a reel 3 rotatably carried on a casing 2 of a tape cutter body 1, the power tape cutter automatically winds off a fixed length of tape through an outlet 5 in a cutter unit 4 installed on the casing 2 by rotating a delivery roller 8 through a predetermined angle, and drives a power blade 7 opposite to a fixed blade 6 provided at the outlet 5. As seen in FIGS. 1, 2, and 9, the cutter unit 4 is removably installed on the casing 2 of the body 1 together with a socket 9 for connecting a signal line from a sensor, described later.

Thus, besides the components required for the above-described action, the delivery roller 8 leading to the outlet 5 for the unwound end of the adhesive wound tape T around the reel 3, a roller drive motor winding off a predetermined length of adhesive tape by driving the delivery roller 8, a power blade drive shaft 10 (FIG. 2) installed on the casing 2 toward the cutter unit 4 which drives the power blade 7 to cut the adhesive tape T, and the power blade drive means consisting of a power blade drive motor lifting and lowering the power blade drive shaft 10, the casing 2 contains earlier-mentioned equipment such as the drive controllers controlling the roller drive motor and power blade drive motor, parts that are not clearly shown in the figures. The casing is also provided with buttons 11 for various operations, such as setting the length of adhesive tape delivered over the delivery roller 8 and instructing the tape cutter to deliver and cut tape to a set length.

As shown in detail in FIGS. 3 through 9, in the cutter unit 4, the fixed blade 6 is securely disposed above the outlet 5, the power blade 7, which ascends and descends opposite to and below the fixed blade 6, and a plate-like movable shutter 15, which prevents a finger from entering the outlet 5, is disposed outside the power blade 7 so that the shutter opens and closes freely and so that a spring 16 urges the shutter in the direction that closes the outlet 5 (upward).

the movable shutter 15 is provided with a retaining piece 20, rotatably held onto a casing 17 of the cutter unit 4 by a pin 18, as means for keeping the shutter in an open position. More specifically, as shown in FIG. 7, the above movable shutter 15 is made of a synthetic resin, and an elastic projection 15*a* is provided that extends downward from the internal bottom of a guide groove 15*b*, formed from below inside the movable shutter 15, and a retaining step 21*a* is provided at the top if the elastic projection, the step being retained by a retaining hook 20*a* (FIGS. 4 and 6) disposed on the retaining piece 20. The Opposite side on which the retaining step 21*a* is provided, a claw 21*b* which retains a lower retaining edge 24*a* of a retaining plate 24, ascending and descending together with the power blade 7, is provided at the elastic projection 15*a* in the lower part of the movable shutter 15. The retaining plate 24 is constructed to slide up and down with its edges guided along the internal lines of the guide groove 15*b* in the movable shutter 15.

The retaining piece 20, rotatably supported by the pin 18, is provided with a pressing part 20*b* for detaching the claw 21*b* from the retaining edge 24*a* of the retaining plate 24 as well as with the retaining hook 20*a*, retaining the retaining step 21*a*, and a spring 28 moves in a direction that allows the retaining hook 20*a* to retain the retaining step 21*a*. The retaining piece 20 is driven by an operator 25, consisting of a solenoid provided in a casing 17, and part of an activating plate 27, installed at the tip of an activating shaft 26 of the operator 25, is positioned below the pressing part 20*b* of the retaining piece 20. Thus, when the activating shaft 26 ascends under the action of the operator 25, the retaining piece 20 rotates counterclockwise about the pin 18 against an urging force produced by the spring 28, and the retaining hook 20*a* of the retaining piece 20 separates from the retaining step 21*a* in the movable shutter 15. At the same time the pressing part 20*b* presses the lower end of the elastic projection 15*a*, thus causing the claw 21*b* to separate from the retaining edge 24*a* of the retaining plate 24, so that the movable shutter 15 moves up due to the urging force of the spring 16. A solenoid does not need to be necessarily used as the operator. Any other equipment may be used to electrically operate the retaining piece 20.

The power blade 7 is provided with an insertion hole 7*a* into which a power blade drive shaft 10 (FIG. 2), disposed on the casing 2 toward the cutter unit 4, to cut the adhesive tape T is inserted. As clearly shown in FIGS. 8 and 9, the retaining plate 24, ascending and descending together with the power blade 7, is provided with projections 24*b* that fit into the insertion hole 7*a* at its both ends, and a small hole 24*c* which communicates with the insertion hole 7*a* is provided between the projections 24*b* so that inserting the projections 24*b* of the retaining plate 24 into the insertion hole 7*a* causes the retaining plate and power blade to be integrated with each other. Not only the above arrangement but other effective means may be used to combine the retaining plate 24 and power blade 7. The power blade 7 and retaining plate 24 are movably held vertically between the casing 17 of the cutter unit 4 and a fixed cover 29 for casing 17. The drive shaft 10, which fits into the insertion hole 7*a* and into the small hole 24*c* through an oval hole 29*a* formed in the cover 29, lifts or lowers the power blade and retaining plate, thereby driving the power blade to cut adhesive tape. The oval hole 29*a* in the cover 29 has slightly larger movable range than that of the power blade drive shaft 10.

Although a known mechanism in which a drive motor rotates a disk, having a crank pin, through a gear speed reducer, and a crank pin moves up and down the drive shaft 10, guided by the casing 2, can be used as power blade drive means, consisting of the drive shaft 10, a power blade drive motor, not shown, in the casing 2, any other drive mechanism may also be used. The drive shaft 10, moved up an downed by means of the power blade drive, cuts adhesive tape between the power blade 7 and fixed blade 6 when it ascends. On the other hand, when the drive shaft 10 descends, the claw 21*b* of the movable shutter 15 retains the retaining edge 24*a* of the retaining plate 24, integrated with the power blade 7, and the retaining hook 20*a* of the retaining piece 20 retains the movable shutter at the retaining step 21*a* therein to return the movable shutter 15 to a position that keeps the shutter open.

The movable shutter 15 is provided with a power blade drive switch 30 (FIG. 5) which operates when the movable shutter substantially closes in cooperation with it. A microswitch, which operates when pressed by an activating projection 15*c* provided on the movable shutter 15, is used as the power blade drive switch 30. However, any other switching mechanism may be used. Electrical connections are made so that the operation of the power blade drive switch 30 causes the power blade 7 to start to cut the adhesive tape T. A tape detection sensor 31 is provided at the outlet 5 for adhesive tape, the sensor detecting tape uses optical input, and the sensor is connected through the socket 9 to a drive controller in the casing 2.

In FIG. 2, the numeral 33 indicates an outlet side delivery roller, separating transferred adhesive tape T from the delivery roller 8 and delivering it.

Figure 3:
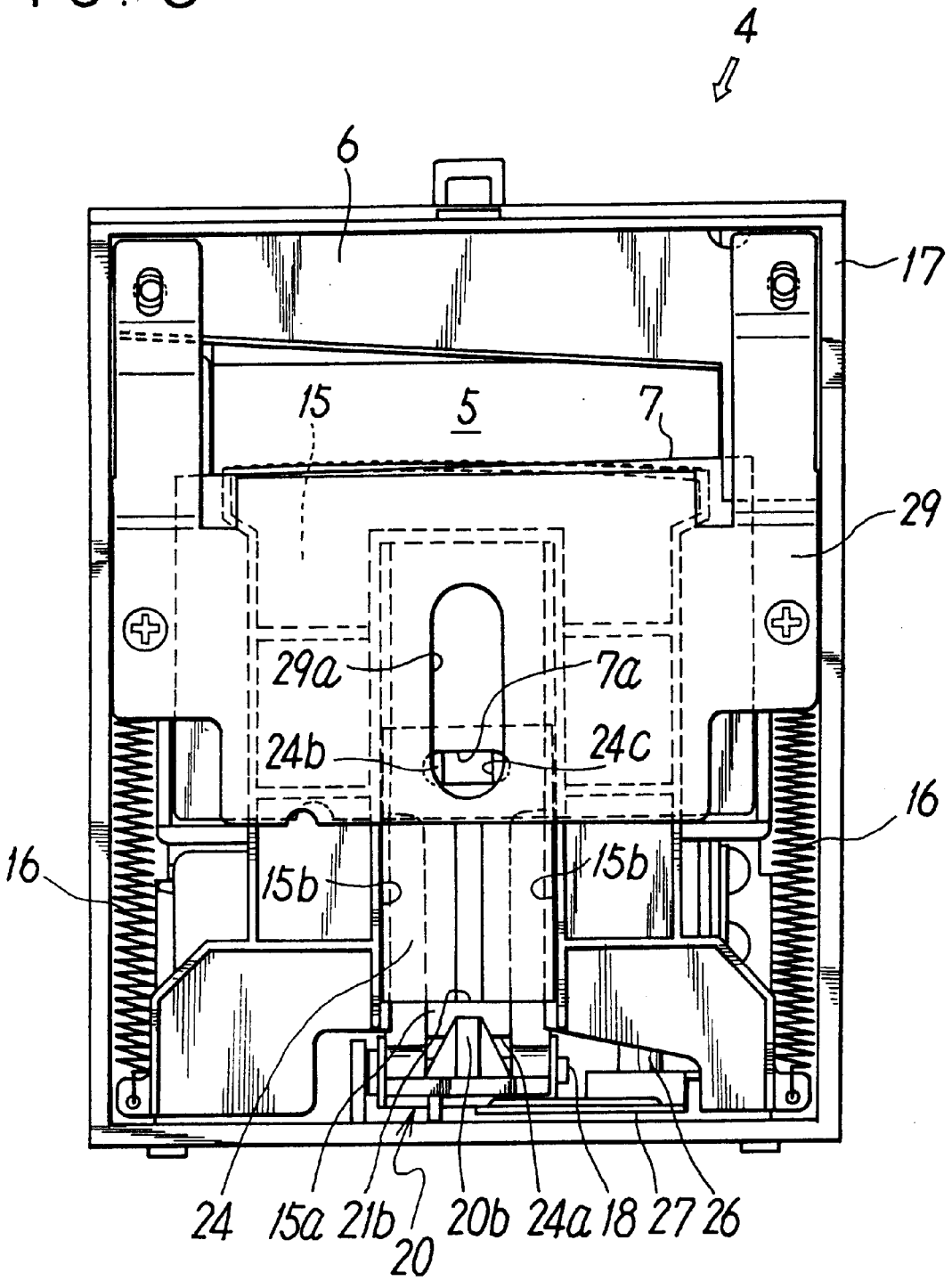
FIG. 3 is an inside front view of a power blade in the cutter unit of the embodiment, the power blade being on standby.
Figure 4:
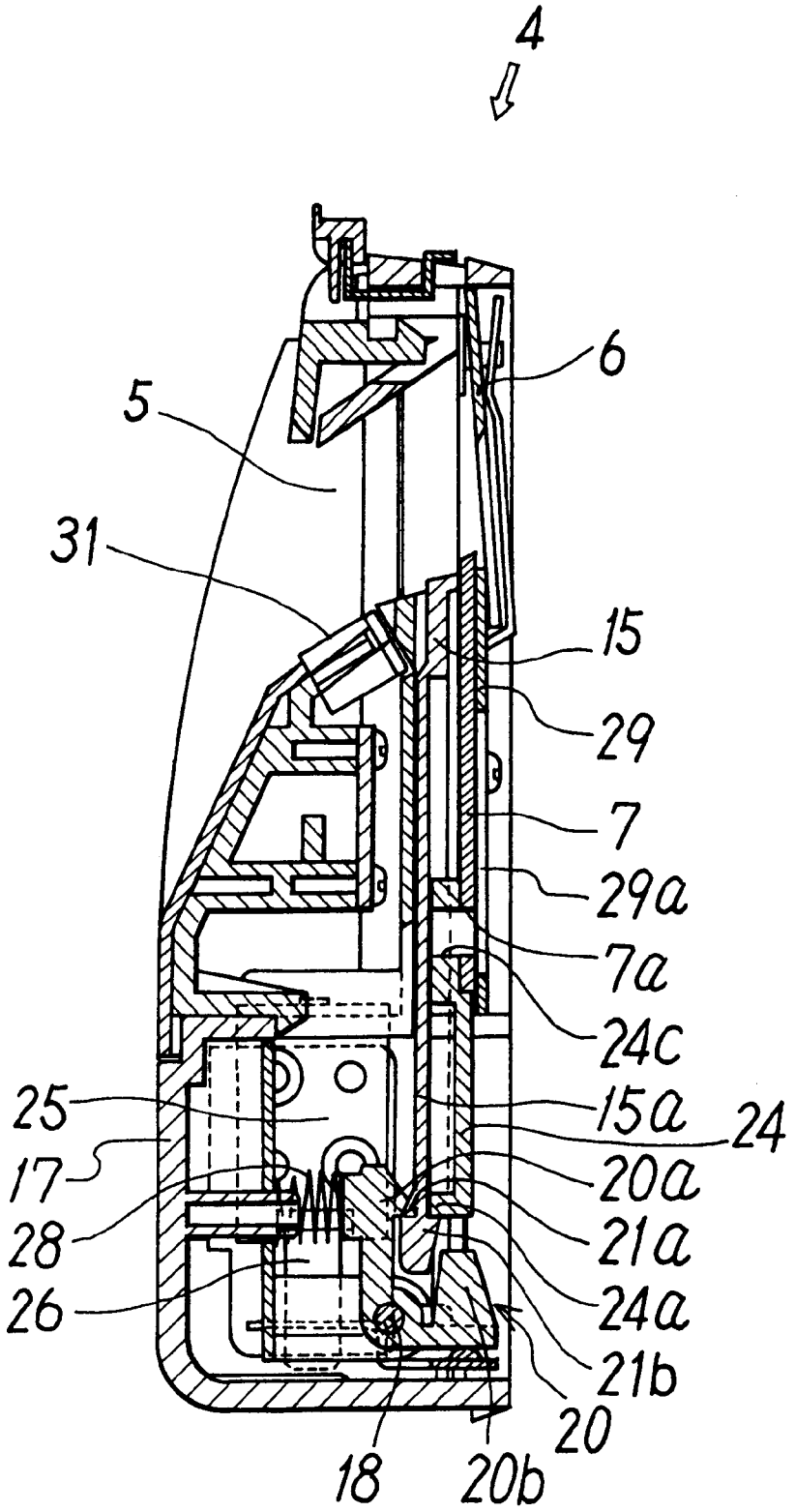
FIG. 4 is a cross-sectional view of a power blade in the cutter unit of the embodiment, the power blade being on standby.

When on standby, as shown in FIG. 3 and 4, the power tape cutter, arranged as described above, uses the sensor 31 to sense whether the adhesive tape has been delivered through the outlet 5 after it is cut (if an automatic winding-off mechanism is provided). Otherwise, when an operation button for instructing adhesive tape to be wound off and cut is pressed, the drive controller produces a signal which triggers the delivery and cutting of tape. According to this signal, the delivery roller 8 rotates to deliver a fixed length of tape (this operation is omitted if tape is only cut). Then the operator 25, consisting of a solenoid, operates, and the activating plate 27, attached to the tip of the activating shaft 26, rotates the retaining piece 20 counterclockwise in FIG. 4, so that the pressing part 20*b* of the retaining piece 20 presses the lower end of the plastic projection 15*a* in the movable shutter 15, thus causing the claw 21*b* to separate from the retaining edge 24*a* of the retaining plate 25. At the same time, the retaining hook 20*a* of the retaining piece 20 separates from the retaining step 21*a* in the movable shutter 15. This action frees the movable shutter 15 from the retaining piece 20, so that the movable shutter 15 moves up, due to urging force of the spring 16, to close the outlet 5, thus preventing a finger from being inserted into the outlet 5.

Since the movable shutter 15 closes the outlet 5, an activating projection 15*c*, installed on the movable shutter 15, presses the power blade drive switch 30 to activate it, thus causing the power blade 7 to start tape cutting. However, if the movable shutter 15 does not close the outlet because of a finger inserted into the outlet or cut tape attached to the surroundings of the outlet 5, the power blade drive switch 30 does not operate, and the power blade 7 does not cut the adhesive tape T. Thus, an accident due to the insertion of a finger into the outlet 5 can be prevented.

Figure 5:
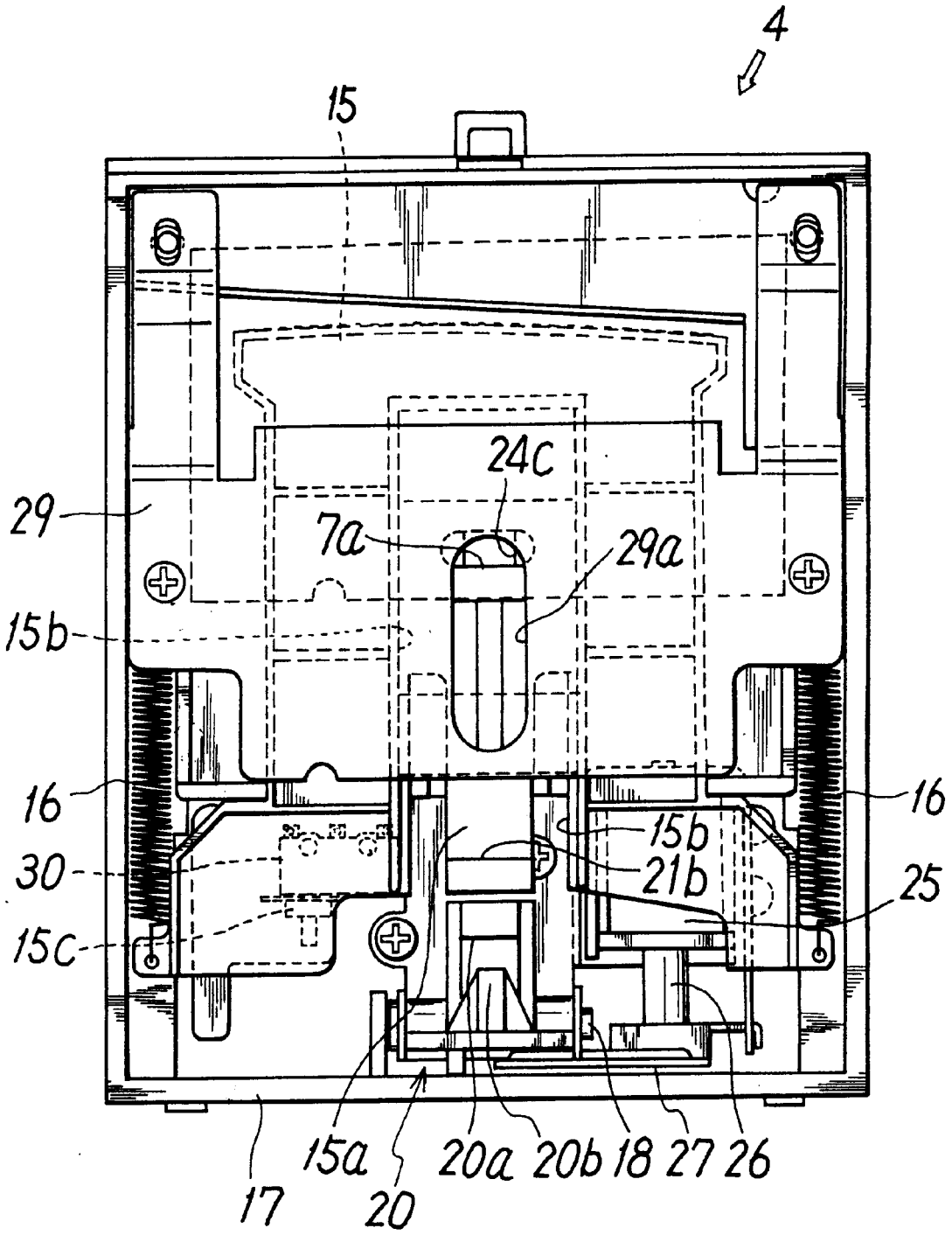
FIG. 5 is an internal front view of a power blade in the cutter unit of the embodiment, the power blade under cutting tape.
Figure 6:
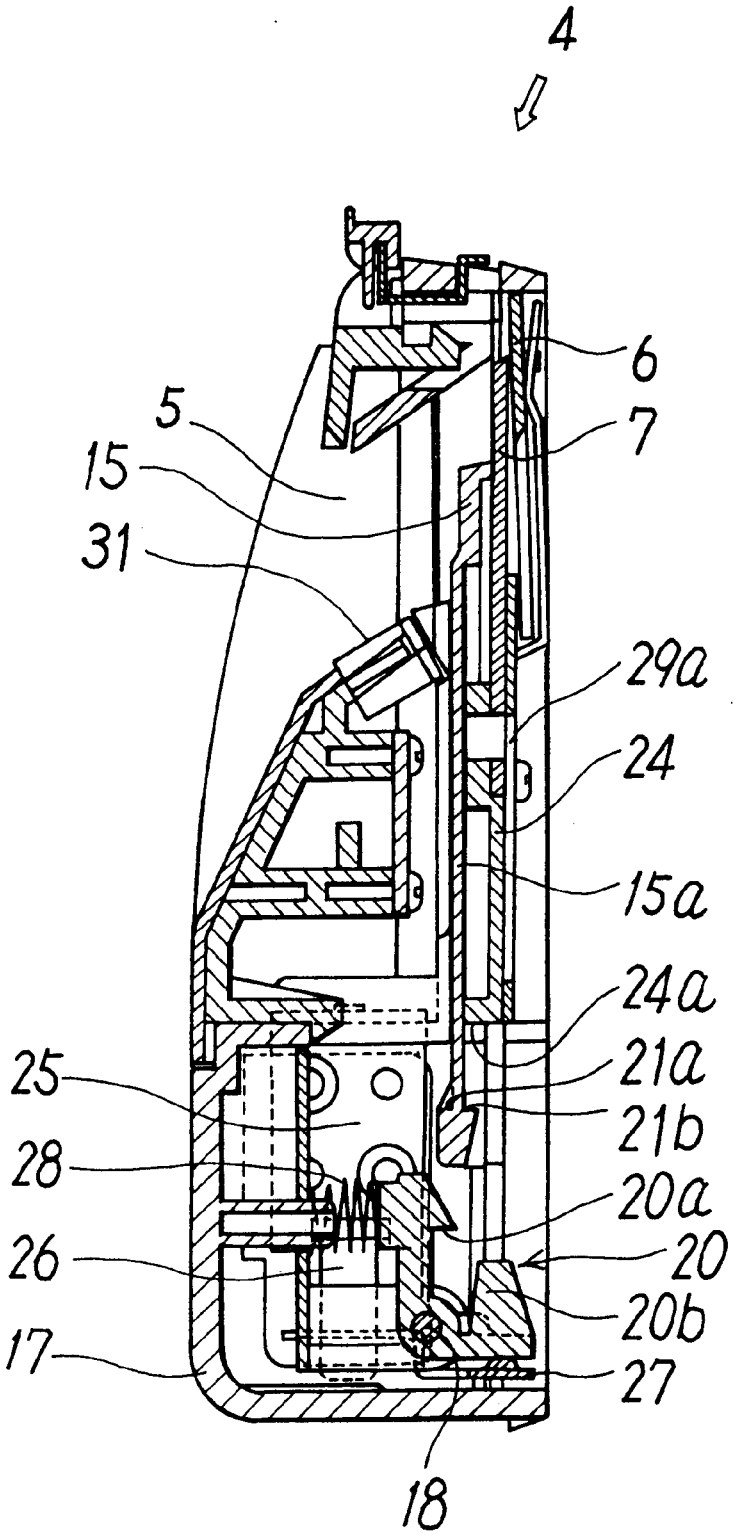
FIG. 6 is a cross-sectional side view of a power blade in the cutter unit of the embodiment, the power blade under cutting tape.
Figure 7:
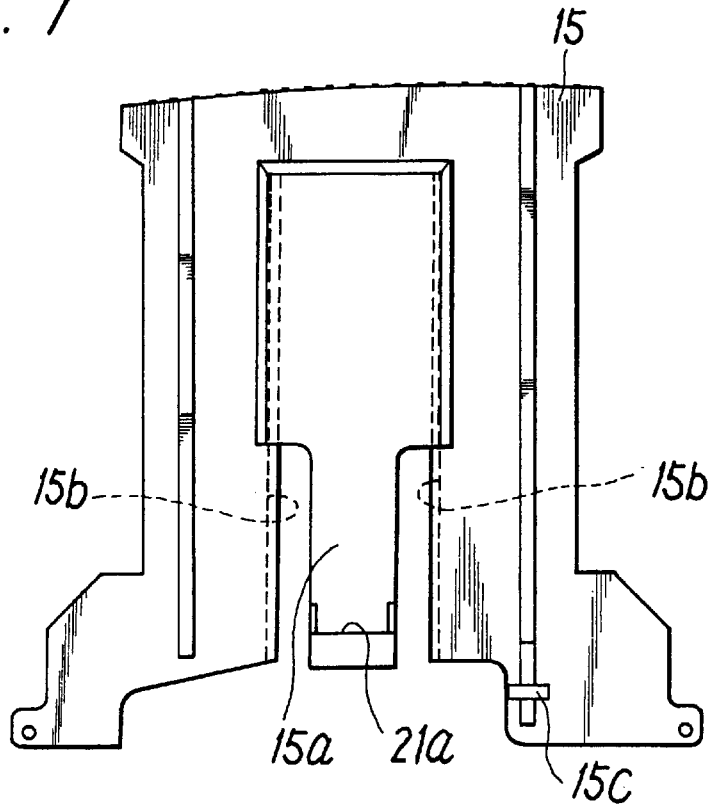
FIG. 7 is a front view of a movable shutter in the cutter unit.
Figure 8:
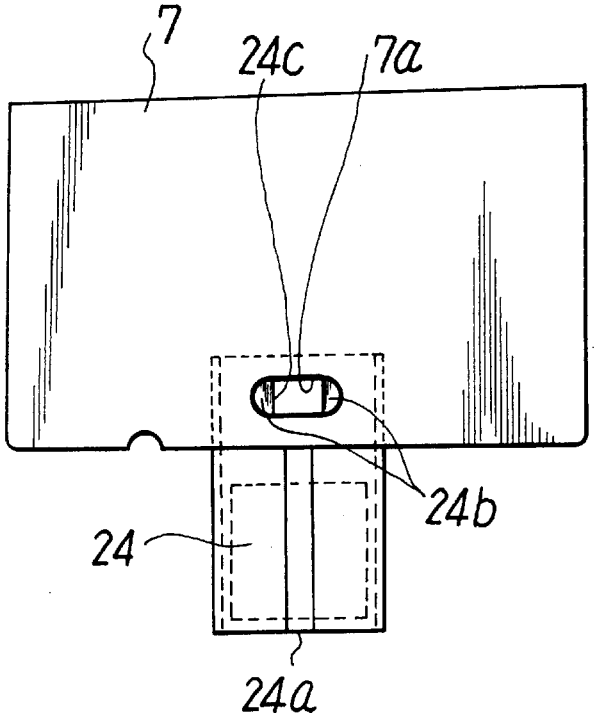
FIG. 8 is a rear view of a power blade and the retaining plate attached thereto.

When the power blade drive switch 80 operates, the power blade drive motor is driven, and the power blade drive shaft 10 moves the power blade 7 up to a position shown in FIGS. 5 and 6, then the power blade cuts the adhesive tape T, which is pulled out until it projects a predetermined length from the outlet 5. Finally, the power blade 7 descends back to the original position thereof. When the power blade returns to its original position, the retaining edge 24*a* of the retaining plate 24, which ascends and descends together with the power blade 7, is retains by the claw 21*b* and opens the outlet 5 by moving down the movable shutter 15. Moreover, the retaining edge 2*a* returns the movable shutter 15 to a state where the retaining means keep the shutter in an open position; that is, to a position where the retaining hook 20*a* of the retaining piece 20 retains the retaining step 21*a* of the movable shutter 15 due to the urging force of the spring 28, thus keeping the shutter 15 in the open position, so that the movable shutter waits for the next cutting and delivery operation, as shown in FIGS. 3 and 4. If adhesive tape continues to be cut automatically, adhesive tape is further delivered.

Thus when the adhesive tape T starts to be delivered and cut, the movable shutter 15 prevents a finger from being inserted into the outlet 5 for adhesive tape. Moreover, if the movable shutter 15 does not operate properly, the delivery and cutting operation is discontinued, thus preventing an accident due to the power blade 7 as much as possible.

As described in the details above, the present invention provides a simple, inexpensive safety device that allows a movable shutter to prevent a finger from being inserted into an outlet when a power tape cutter starts to cut adhesive tape and that discontinues the delivery and cutting operation, thus preventing an accident due to a power blade as much as possible, even if the movable shutter does not operate properly.

What is claimed is:

1. In a power tape cutter which leads out an end of an adhesive tape wound on a reel through an outlet and cuts the end of the adhesive tape by driving a power blade provided at the outlet, a safety device comprising:

a movable shutter disposed outside the power blade which is turned on in conjunction with operation of the movable shutter, said movable shutter being operated to close the outlet before operation of the power blade at commencement of cutting the end of the adhesive tape;

a means for retaining the movable shutter so as to lock the shutter in an open position and unlock the shutter when the safety device responds to a signal to start cutting the end of the adhesive tape;

a power blade drive switch operated to cause the power blade to start to cut the end of the adhesive tape; and a power blade drive means provided so that, when the power blade drive switch is operated, the power blade starts cutting the end of the adhesive tape, and when the power blade returns to its original position after cutting the end of the adhesive tape, the movable shutter opens.

2. A safety device in a power tape cutter according to claim 1, further comprising:

a tape detection sensor which detects a presence of the adhesive tape at the outlet and outputs to a device driver a signal for starting to cut the end of the adhesive tape.

3. A safety device in a power tape cutter according to claim 1, characterized in that the movable shutter is formed into a plate which ascends or descends to switch the outlet between open and closed states.

4. A safety device in a power tape cutter which leads out an end of an adhesive tape wound on a reel through an outlet and cuts the end of the adhesive tape by driving a power blade provided at the outlet, said safety device comprising:

a movable shutter disposed outside the power blade at the outlet;

a means for retaining the movable shutter so as to lock the shutter in an open position and unlock the shutter when the safety device responds to a signal to start cutting the end of the adhesive tape;

a power blade drive switch; and a power blade drive means provided so that, when the power blade drive switch is operated, the power blade starts cutting the end of the adhesive tape, and when the power blade returns to its original position after cutting the end of the adhesive tape, the movable shutter opens;

further characterized in that:

the power blade is adapted to ascend from below a fixed blade above the outlet;

a retaining plate, which ascends or descends together with the power blade, is provided with a retaining edge which retains a claw of the movable shutter when the power blade drive means lowers the power blade and which returns the movable shutter to a state where the retaining means can keep the shutter locked in the open position; and the retaining means is provided with a retaining hook that separates from a step for retaining the movable shutter when the safety device operates, and a separating section that contains an urging section for separating the claw from the retaining edge of the retaining plate.

5. A safety device in a power tape cutter according to claim 4, characterized in that:

the movable shutter is formed into a plate which ascends or descends to switch the outlet between open and closed states; and the movable shutter is provided with a guide groove that is open at a bottom and an elastic member that extends downwardly from inside of the bottom of the guide groove, a tip of the elastic member being provided with the claw which is retained on the retaining edge of the retaining plate and with the step on which the retaining hook of the retaining means is retained opposite to the claw.

6. A safety device in a power tape cutter according to claim 5, characterized in that:

the retaining plate fits into and slides along the guide groove of the movable shutter.

7. A safety device in a power tape cutter according to claim 4, characterized in that:

the retaining means includes a retaining section supported by a pin in such a manner that the retaining means can slide and rotate under the action of a device driver to free the movable shutter when the movable shutter is retained; and the retaining section has a spring that returns the retaining hook to a position where the retaining book is retained on the step for retaining the movable shutter.

8. A safety device in a power tape cutter according to claim 4, characterized in that:

the power blade drive means has a power blade drive shaft which lifts or lowers the power blade and retaining plate together.

9. A safety device in a power tape cutter which leads out an end of an adhesive tape wound on a reel through an outlet and cuts the end of the adhesive tape by driving a power blade provided at the outlet, said safety device comprising:

a movable shutter disposed outside the power blade at the outlet;

a means for retaining the movable shutter so as to lock the shutter in an open position and unlock the shutter when the safety device responds to a signal to start cutting the end of the adhesive tape;

a power blade drive switch; and a power blade drive means provided so that, when the power blade drive switch is operated, the power blade starts cutting the end of the adhesive tape, and when the power blade return to its original position after cutting the end of the adhesive tape, the movable shutter opens;

further characterized in that:

the movable shutter has an activating projection which presses the power blade drive switch when the movable shutter descends.

10. A safety device in a power tape cutter which leads out an end of an adhesive tape wound on a reel through an outlet and cuts the end of the adhesive tape by driving a power blade provided to the outlet, said safety device comprising:

a movable shutter disposed outside the power blade at the outlet;

a means for retaining the movable shutter so as to lock the shutter in an open position and unlock the shutter when the safety device responds to a signal to start cutting the end of the adhesive tape;

a power blade drive switch; and a power blade drive means provided so that, when the power blade drive switch is operated, the power blade starts cutting the end of the adhesive tape, and when the power blade returns to its original position after cutting the end of the adhesive tape, the movable shutter opens;

further characterized in that:

the retaining means includes a retaining section supported by a pin in such a manner that the retaining means can slide and rotate under the action of a device driver to free the movable shutter when the movable shutter is retained.

11. A safety device in a power tape cutter which leads out an end of an adhesive tape wound on a reel through an outlet and cuts the end of the adhesive tape by driving a power blade provided at the outlet, said safety device comprising:

a movable shutter disposed outside the power blade at the outlet;

a means for retaining the movable shutter so as to lock the shutter in an open position and unlock the shutter when the safety device responds to a signal to start cutting the end of the adhesive tape;

a power blade drive switch; and a power blade drive means provided so that, when the power blade drive switch is operated, the power blade starts cutting the end of the adhesive tape, and when the power blade returns to its original position after cutting the end of the adhesive tape, the movable shutter opens;

further characterized in that:

the retaining means includes a retaining section supported by a pin in such a manner that the retaining means can slide and rotate under the action of a device driver to unlock the movable shutter; and the device driver, which unlocks the movable shutter, includes a solenoid that rotates the retaining section.

12. In a power tape cutter which automatically winds off a fixed length of adhesive tape that is wound on a reel mounted on a casing of a tape cutter body in such a way that the reel can rotate a delivery roller through a certain angle to deliver the fixed length of adhesive tape from an outlet in a cutter unit installed on the casing, and the tape is cut by a power blade installed opposite a fixed blade, an improvement comprising:

a movable shutter disposed outside the power blade which is turned on in conjunction with operation of the movable shutter, said movable shutter being operated to close the outlet before operation of the power blade at commencement of cutting the end of the adhesive tape;

a retaining means which retains the movable shutter so to lock the shutter in an open position and which unlocks the shutter when a device driver responds to a signal to start cutting the fixed length of the adhesive tape;

a power blade drive switch operated to cause the power blade to start to cut the end of the adhesive tape; and a power blade drive means provided so that, when the power blade drive switch is operated, the power blade starts cutting the fixed length of the adhesive tape, and when the power blade returns to its original position after cutting the fixed length of the adhesive tape, the movable shutter opens;

wherein the fixed blade, the power blade, the movable shutter, the retaining means, the device driver, and the power blade drive switch are all incorporated in the casing of the tape cutter body.

* * * * *